US009702332B2

(12) United States Patent
Shibata et al.

(10) Patent No.: US 9,702,332 B2
(45) Date of Patent: Jul. 11, 2017

(54) IGNITION DEVICE

(71) Applicant: DENSO CORPORATION, Kariya, Aichi-pref. (JP)

(72) Inventors: Masamichi Shibata, Toyota (JP); Koichi Hattori, Ichinomiya (JP); Atsuya Mizutani, Nagoya (JP)

(73) Assignee: DENSO CORPORATION, Kariya (JP)

( * ) Notice: Subject to any disclaimer, the term of this patent is extended or adjusted under 35 U.S.C. 154(b) by 375 days.

(21) Appl. No.: 14/070,630

(22) Filed: Nov. 4, 2013

(65) Prior Publication Data

US 2014/0123967 A1 May 8, 2014

(30) Foreign Application Priority Data

Nov. 2, 2012 (JP) ..... 2012-242298
Feb. 12, 2013 (JP) ..... 2013-024186

(51) Int. Cl.
*F02P 9/00* (2006.01)
*F02P 3/04* (2006.01)
*F02P 15/00* (2006.01)

(52) U.S. Cl.
CPC ..... *F02P 9/002* (2013.01); *F02P 3/0442* (2013.01); *F02P 15/005* (2013.01); *F02P 9/007* (2013.01)

(58) Field of Classification Search
CPC ..... F02P 15/005; F02P 9/002; F02P 3/0442; F02P 9/007; H01T 1/22; F02B 2023/102
(Continued)

(56) References Cited

U.S. PATENT DOCUMENTS 5,456,241 A * 10/1995 Ward ..... F02P 3/0892 123/169 EL
8,866,369 B2 * 10/2014 Gfell ..... H01T 13/08 313/141
(Continued)

FOREIGN PATENT DOCUMENTS

JP 61-178561 8/1986
JP 06-080313 10/1994
(Continued)

OTHER PUBLICATIONS

Office Action (3 pages) dated Sep. 15, 2015, issued in corresponding Japanese Application No. 2013-024186 and English translation (3 pages).

*Primary Examiner* — Hung Q Nguyen
*Assistant Examiner* — Xiao Mo
(74) *Attorney, Agent, or Firm* — Nixon & Vanderhye P.C.

(57) ABSTRACT

An ignition device includes a spark plug and an ignition coil. The spark plug is attached to a cylinder head such that a center electrode and a ground electrode project into a combustion chamber. In an internal combustion engine, airflow is generated in a predetermined direction to the spark plug during a compression step. The ignition coil has a primary coil and a secondary coil. An output voltage of the secondary coil after interruption of energization of the primary coil is restricted to a predetermined voltage or less. The ground electrode has a leg portion extending from a housing of the spark plug and an opposing portion that extends in a direction intersecting with the leg portion and forms a gap by opposing the center electrode. The leg portion is attached to a position further upstream than the gap in a flow direction of the airflow during the compression step.

12 Claims, 6 Drawing Sheets

(58) Field of Classification Search
USPC ..... 123/623; 313/123, 140–143
See application file for complete search history.

(56) References Cited

U.S. PATENT DOCUMENTS

| | | | | |
|---|---|---|---|---|
| 2002/0000765 | A1* | 1/2002 | Suzuki | H01T 13/34 313/141 |
| 2004/0173194 | A1* | 9/2004 | Fuma | F02P 3/02 123/634 |
| 2007/0103046 | A1* | 5/2007 | Tinwell | H01T 13/20 313/143 |

FOREIGN PATENT DOCUMENTS

| | | |
|---|---|---|
| JP | 2005-299679 | 10/2005 |
| JP | 2007-250344 | 9/2007 |
| JP | 2008-303840 | 12/2008 |
| JP | 2011-081978 | 4/2011 |

* cited by examiner

COMBUSTION CHAMBER
100
110
G

COMBUSTION CHAMBER
100
110

COMBUSTION CHAMBER
100
110
γ-EFFECT
α-EFFECT

COMBUSTION CHAMBER
100
110
ELECTRIC FIELD INTENSIFIED

COMBUSTION CHAMBER
100
110
AIR FLOW
F
⊖ : FREE ELECTRONS
⊕ : POSITIVE IONS
◎ : GASEOUS MOLECULE

IGNITION DEVICE

CROSS-REFERENCE TO RELATED APPLICATION

This application is based on and claims the benefit of priority from Japanese patent applications No. 2012-242298, filed on Nov. 2, 2012, and No. 2013-024186, filed on Feb. 12, 2013, the disclosure of which is incorporated herein in its entirety by reference.

BACKGROUND

Technical Field

The present invention relates to an ignition device that includes an ignition coil and a spark plug having a center electrode and a ground electrode that project into a combustion chamber of an internal combustion engine, in which a high voltage is applied to a gap that is a space between the center electrode and the ground electrode to generate a discharge spark.

Related Art

A spark plug for an internal combustion engine that includes a housing, a plug insulator, a center electrode, and a ground electrode is known. The outer periphery of the housing is provided with an attachment screw portion. The plug insulator is held within the housing. The center electrode is held within the plug insulator. The ground electrode forms a gap between itself and a tip portion of the center electrode. For example, the ground electrode is substantially L-shaped. The ground electrode is provided such as to oppose the tip portion of the center electrode in an axial direction of the spark plug.

As a result of a voltage being applied to the center electrode, an electron avalanche phenomenon occurs in the gap formed by the opposing portions of the center electrode and the ground electrode. The densities of free electrons and positive ions increase. As a result, breakdown occurs and a discharge spark is generated in the gap.

Within the combustion chamber of the internal combustion engine, airflow in a predetermined direction is generated during a compression step, for example, depending on the position of an intake port, the shape of the top surface of a piston, and the like. Here, when the flow of air-fuel mixture to the gap in the spark plug within the combustion chamber is obstructed, ignitability may decrease. Therefore, to prevent obstruction of the flow of air-fuel mixture by the ground electrode and improve ignitability, a technology is proposed in which the ground electrode is provided in a position in which the airflow of the air-fuel mixture is not obstructed (see JP-A-2005-299679).

On the other hand, when wear of the electrodes in the spark plug progresses as a result of increasing travel distance and the like and the gap widens, the voltage required to be applied to the gap to generate the discharge spark rises. As a result, the voltage applied to the gap may exceed the breakdown voltage of the plug insulator. Reliability of the spark plug may decrease.

As a measure against such issues, there is a technology in which the voltage applied to the center electrode is restricted to a predetermined voltage through use of a voltage regulator, such as a Zener diode or a varistor. Even when the applied voltage is restricted to the predetermined voltage, the densities of free electrons and positive ions increase in the gap between the electrodes as a result of the voltage being continuously applied to the center electrode. Breakdown occurs, and a discharge spark is generated in the gap.

As a result, excessive increase of the voltage applied to the center electrode can be prevented. Decrease in the reliability of the spark plug can be suppressed.

When the voltage applied to the center electrode is restricted to a predetermined voltage, the spark plug can be protected. However, compared to when the restriction is not set, the amount of time from when the voltage is applied to the center electrode until the discharge spark is generated (discharge waiting period) increases.

Therefore, in a discharge waiting state, the likelihood increases that the positive ions produced in the gap will be carried away by the airflow of the air-fuel mixture during the compression step. As a result, a problem arises in that the amount of time from when voltage application to the center electrode starts until the discharge spark is generated varies depending on the state of airflow.

SUMMARY

An exemplary object of the present disclosure is to provide an ignition device capable of suppressing variations in a discharge waiting period when a voltage is applied to a gap and stabilizing the combustion state of an internal combustion engine.

An ignition device according to an exemplary embodiment of the present disclosure includes: a spark plug that is attached to a cylinder head of an internal combustion engine such that a center electrode and a ground electrode project into a combustion chamber of the internal combustion engine: and an ignition coil having a primary coil and a secondary coil that are magnetically coupled with each other. In the spark plug, the center electrode and the ground electrode oppose each other in an axial direction of the spark plug. A gap is formed between the center electrode and the ground electrode. In the gap, a discharge spark is generated. To generate the discharge spark in the gap, after the start of energization of the primary coil, energization of the primary coil is interrupted, and a high voltage is applied to the center electrode.

Furthermore, the internal combustion engine generates airflow in a predetermined direction to the spark plug during a compression step. A voltage restricting means is included that restricts the output voltage of the secondary coil after interruption of the energization of the primary coil to a predetermined voltage or less. The ground electrode has a leg portion that extends from a housing of the spark plug and an opposing portion that extends in a direction intersecting with the leg portion and forms the gap by opposing the center electrode. The leg portion is attached to a position further upstream than the gap in the flow direction of the airflow during the compression step.

In the above-described configuration, the leg portion of the ground electrode is disposed in a position further upstream than the gap in relation to the airflow of air-fuel mixture generated during the compression step, within the combustion chamber of the internal combustion engine. The intensity of the airflow of air-fuel mixture is weakened by the leg portion of the ground electrode near the gap.

Therefore, an issue in which positive ions generated in the gap are dispersed by the airflow of air-fuel mixture can be suppressed. Therefore, in the ignition device in which a discharge waiting period is generated as a result of the voltage applied to the center electrode being restricted to a predetermined voltage, a delay in the electron avalanche phenomenon accompanying the dispersion of positive ions can be suppressed. Variations in the discharge waiting period can be suppressed. As a result, stabilization of the combustion state of the internal combustion engine can be achieved.

DESCRIPTION OF EMBODIMENTS

First Embodiment

Figure 1:
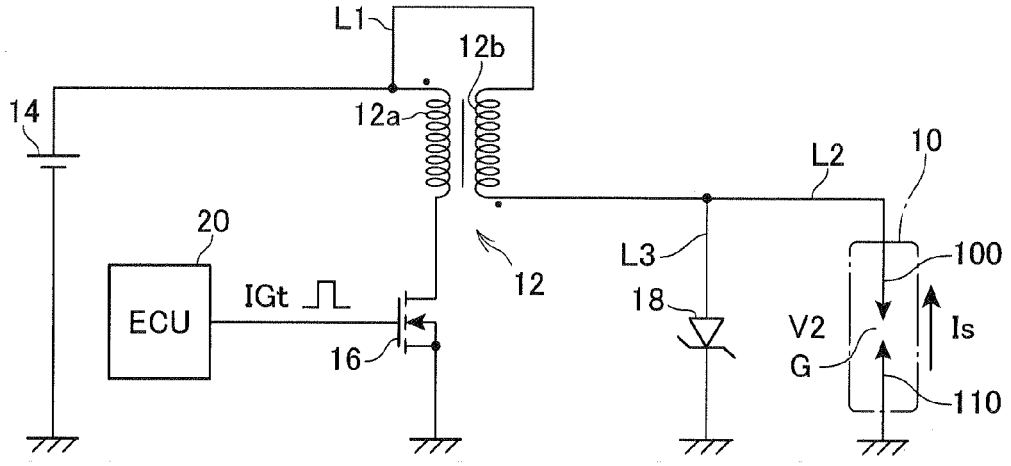
FIG. 1 is a diagram showing a configuration of an ignition device according to a first embodiment.

An embodiment in which an ignition device of the present invention is applied to an in-vehicle spark ignition engine will hereinafter be described with reference to the drawings. FIG. 1 shows an overall configuration of an ignition device according to a first embodiment.

As shown in FIG. 1, the ignition device includes a spark plug 10 and an ignition coil 12. Specifically, the spark plug 10 includes a center electrode 100 and a ground electrode 110. The spark plug 10 is attached to a cylinder head of an engine and functions to generate a discharge spark in a combustion chamber.

The ignition coil 12 includes a primary coil 12*a* and a secondary coil 12*b* that is magnetically coupled with the primary coil 12*a*. One end of both ends of the secondary coil 12*b* is connected to the positive side of a battery 14 (equivalent to a component having an electric potential that serves as reference) by a low-voltage side path L1. The other end of the secondary coil 12*b* is connected to the center electrode 100 by a connection path L2. The negative side of the battery 14 is grounded. According to the first embodiment, a lead-acid battery having a terminal voltage Vb of 12V is used as the battery 14. The ground potential is zero volts.

One end of both ends of the primary coil 12*a* is connected to the positive side of the battery 14. The other end of the primary coil 12*a* is grounded with an input/output terminal of a switching element 16 therebetween. The switching element 16 is an electronically controlled opening/closing means. According to the first embodiment, an N-channel metal-oxide-semiconductor field-effect transistor (MOSFET) is used as the switching element 16.

A constant voltage path L3, of which one end is grounded, is connected to the connection path L2. The constant voltage path L3 includes a Zener diode 18 that is a voltage regulator serving as a voltage restricting means. Specifically, the anode of the Zener diode 18 is connected to the connection path L2 side. The cathode of the Zener diode 18 is connected to the grounding area side.

An electronic control unit (referred to, hereinafter, as an ECU 20) is mainly configured by a microcomputer. The ECU 20 controls the ignition device. The ECU 20 outputs an ignition signal IGt to an open/close control terminal (gate) of the switching element 16 to make the spark plug 10 generate a discharge spark.

Here, ignition control performed by the ECU 20 will be described. First, as a result of the ignition signal IGt inputted into the gate of the switching element 16 being an ON ignition signal, the switching element 16 is turned ON. As a result, the flow of a current from the battery 14 to the primary coil 12*a* starts. Accumulation of magnetic energy in the ignition coil 12 starts. According to the first embodiment, when the primary coil 12*a* is energized, the polarity on the center electrode 100 side of the both ends of the secondary coil 12*b* is positive. The polarity on the low-voltage side path L1 side of the secondary coil 12*b* is negative.

Next, after the primary coil 12*a* is energized, the switching element 16 is turned OFF as a result of the ignition signal IGt becoming an OFF ignition signal. The polarities on both ends of the secondary coil 12*b* are then reversed. In addition, a high voltage is induced in the secondary coil 12*b*. As a result, a high voltage is applied to a gap G that is a space between the center electrode 100 and the ground electrode 110 of the spark plug 10.

According to the first embodiment, the Zener diode 18 is provided on the constant voltage path L3. Therefore, when the voltage (secondary voltage V2) applied to the gap in the spark plug 10 begins to exceed a breakdown voltage Vz of the Zener diode 18, a voltage drop amounting to the breakdown voltage Vz occurs in the Zener diode 18. The secondary voltage V2 is restricted by the breakdown voltage Vz. In other words, as indicated by the solid line in FIG. 2, during the period in which the secondary voltage V2 attempts to exceed the breakdown voltage Vz (time t1 to t2), the secondary voltage V2 is held at the breakdown voltage Vz.

Then, during the period in which the secondary voltage V2 is held at the breakdown voltage Vz, when the density of charged particles present in the gap, or in other words, the densities of the free electrons and the positive ions exceeds a predetermined value, a discharge spark is generated in the gap. A discharge current Is flows from the ground electrode 110 to the center electrode 100. As a result of a configuration such as this, the discharge voltage of the spark plug 10 is prevented from becoming excessively high, unlike the discharge voltage in an ignition device that does not include the Zener diode 18 and the constant voltage path L3 (indicated by the dashed line in FIG. 2).

Figure 2:
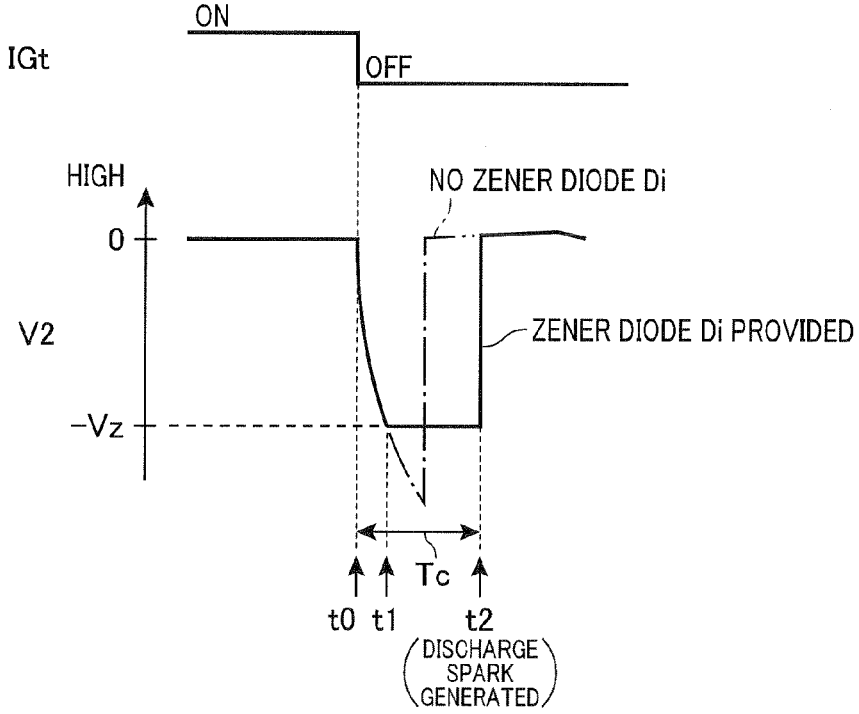
FIG. 2 is a diagram showing transitions in a secondary voltage of the ignition device shown in FIG. 1.

In FIG. 2, time t0 is the timing at which application of voltage to the center electrode 100 starts. Period Tc from t0 to t2 (the timing at which the discharge spark is generated) is the discharge waiting period. The discharge waiting period includes the period during which the secondary voltage V2 is held at the breakdown voltage Vz (time t1 to t2). The longer the holding period of the breakdown voltage Vz is, the longer the discharge waiting period.

Figure 3:
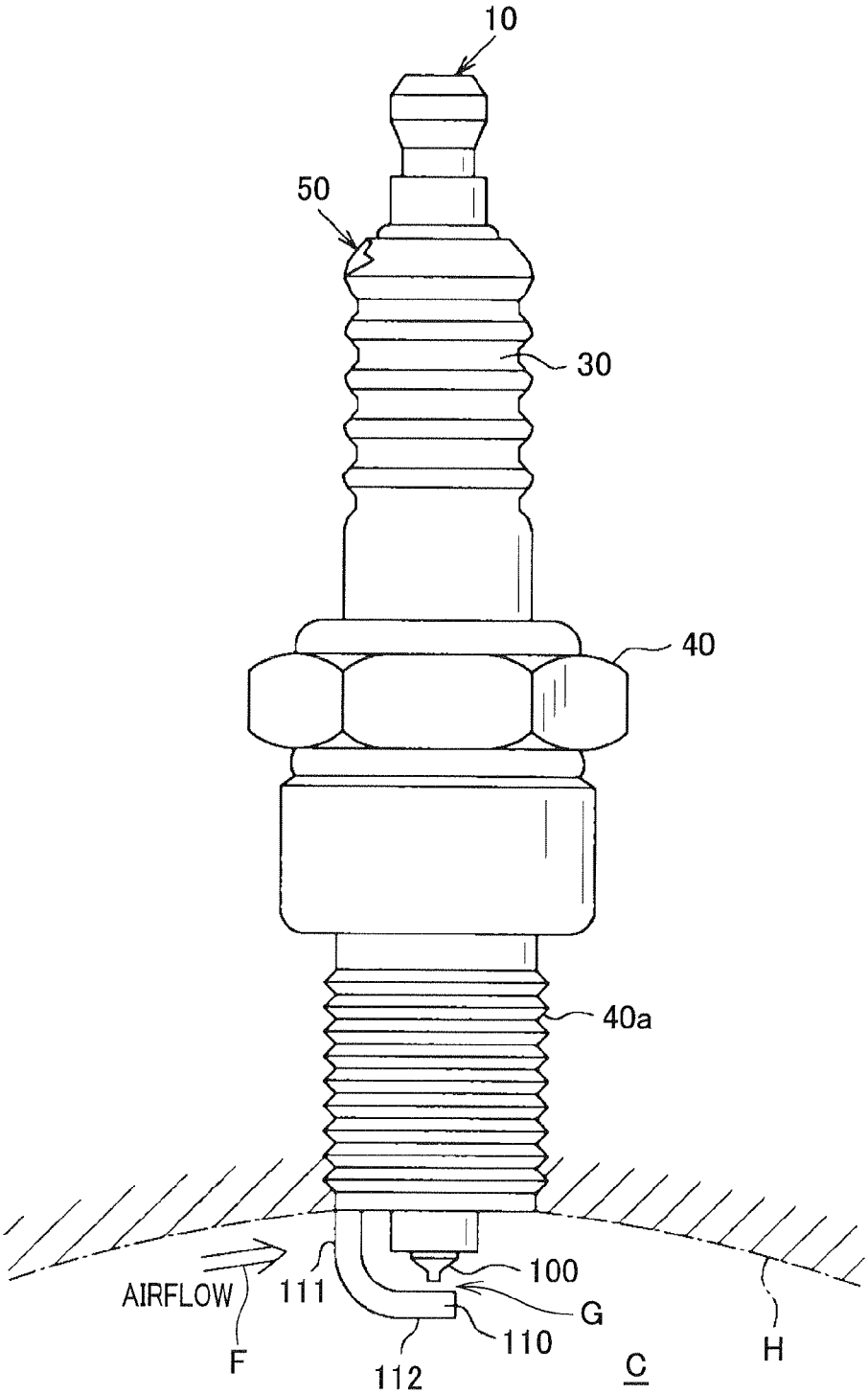
FIG. 3 is a diagram showing a configuration of a spark plug of the ignition device shown in FIG. 1.

FIG. 3 shows a configuration of the spark plug 10. The spark plug 10 is attached to a cylinder head H of the engine in a state in which the center electrode 100 and the ground electrode 110 project into a combustion chamber C of the engine. In the combustion chamber C, airflow in a predetermined direction is generated during a compression step depending on the position of an intake port, the shape of the top surface of a piston, and the like. In FIG. 3, the air-fuel mixture flows from the left side of the drawing towards the right side (i.e., from the intake port side to a discharge port side).

The center electrode 100 is held by an insulator 30. The center electrode 100 and the ground electrode 110 are insulated from each other by the insulator 30. In addition, a tip portion of the center electrode 100 is formed narrower than a body portion that is held by the insulator 30.

The ground electrode 110 is substantially L-shaped. A leg portion 111 is welded and fixed to the bottom end surface of a housing 40. The leg portion 111 of the ground electrode 110 extends from the bottom end surface of the housing 40 along the substantially axial direction of the center electrode 100. An opposing portion 112 of the ground electrode 110 extends in a direction intersecting with the leg portion 111 and opposes the center electrode 100. The gap G is formed between the center electrode 100 and the opposing portion 112 of the ground electrode 110.

The housing 40 is composed of a metal member. A male screw portion 40*a* is formed on the outer periphery of the housing 40. The spark plug 10 is attached to the cylinder head H by the male screw portion 40*a* being screwed into a female screw portion of the cylinder head H. As a result of the spark plug 10 being attached to the cylinder head H, the electric potential of the housing 40 and the ground electrode 110 becomes the ground potential.

Figures 4A, 4B, 4C, 4D, 4E:
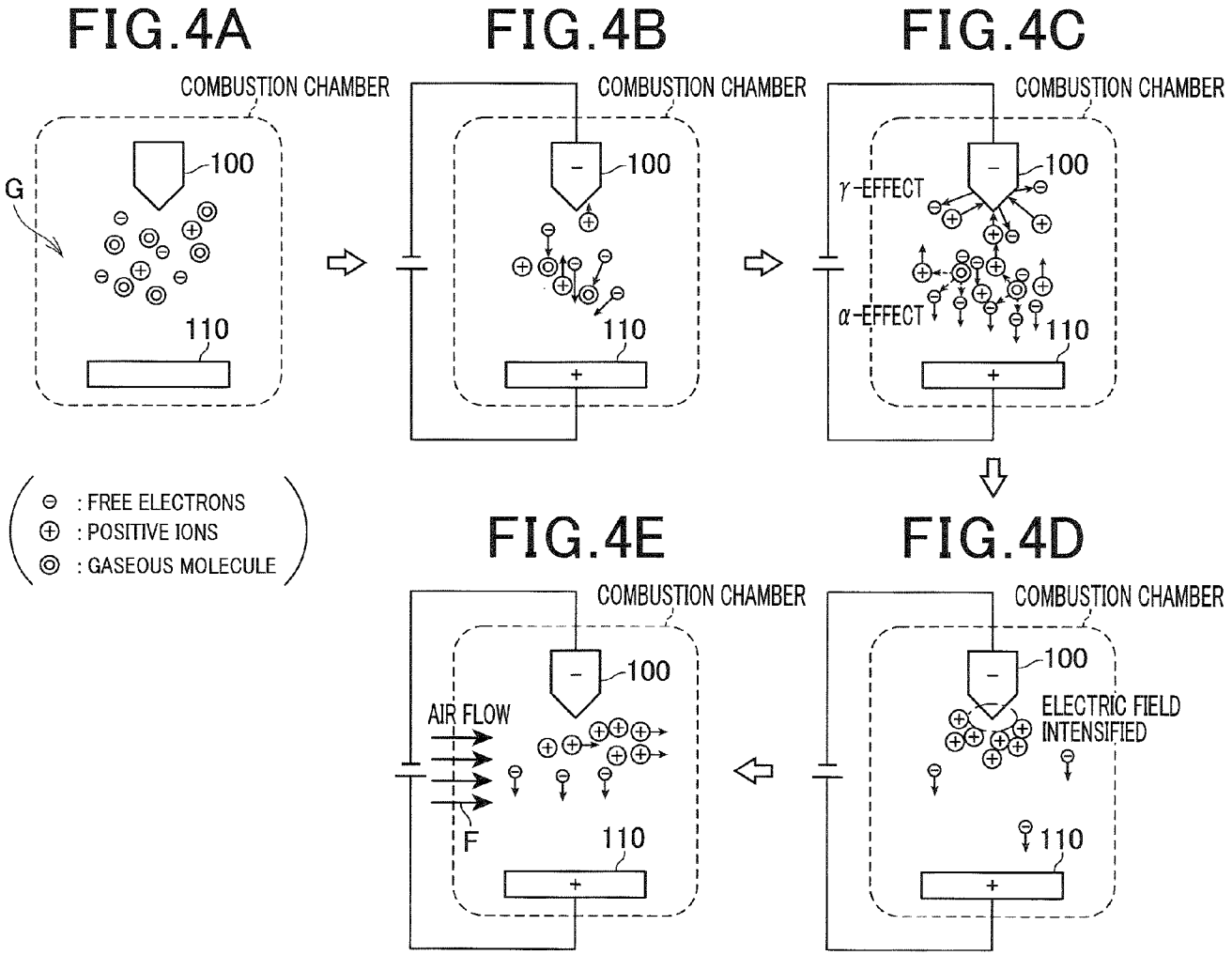
FIGS. 4A to 4E are diagrams showing effects that airflow of an air-fuel mixture has on gas in a gap between a center electrode and a ground electrode of the spark plug.

FIGS. 4A to 4E show the transitions in the state of gas in the gap G. Specifically, FIG. 4A shows the state of gas before a high voltage is applied to the gap G. FIGS. 4B to 4E show the state of gas while the high voltage is applied to the gap G.

As shown in FIG. 4A, free electrons are present in the gap G. When the high voltage is applied to the gap G, as shown in FIG. 4B, the free electrons are accelerated by an electric field and collide with gaseous molecules. Therefore, as shown in FIG. 4C, free electrons are released from the gaseous molecules, and positive ions are produced ($\alpha$-process). In addition, the positive ions produced in this way are attracted to the center electrode 100 on which a negative voltage is applied. As a result of the positive ions colliding into the center electrode 100, free electrons are released from the center electrode 100 ($\gamma$-process).

In a typical spark plug, the area of the center electrode is smaller than the area of the ground electrode in the opposing area between the center electrode and the ground electrode. For example, in the configuration shown in FIG. 3, the center electrode 100 works as a needle electrode. The ground electrode 110 works as a plate electrode. Therefore, concentration of an electric field occurs in the space near the center electrode 100.

As a result, as shown in FIG. 4D, the $\alpha$-effect occurs in a concentrated manner in the space near the center electrode 100, causing the density of positive ions to increase near the center electrode 100. When the density of positive ions increase near the center electrode 100, the electric field is intensified between the center electrode 100 that is negatively charged and the positive ions present near the center electrode 100. As a result, the electron avalanche phenomenon is precipitated, and the discharge spark is generated in the gap G.

Here, during the period from when the high voltage is applied to the gap G until the discharge spark is generated, as shown in FIG. 4E, the positive ions near the center electrode 100 are carried outside of the space of the gap G if a flow of air-fuel mixture (airflow) is generated in the gap G. When the positive ions are carried away, the electric field near the center electrode 100 weakens. This is considered to result in the widening of the range of variation in the discharge waiting period from when the voltage is applied to the gap G until the discharge spark is generated.

According to the first embodiment, the secondary voltage V2 is restricted to (held at) the breakdown voltage Vz by the Zener diode 18, as described above. Therefore, the discharge waiting period tends be long. As a result, the positive ions near the center electrode 100 are considered to become prone to dispersion by the airflow of air-fuel mixture during the compression step, and the range of variation in the discharge waiting period widens. Therefore, to reduce the range of variation in the discharge waiting period, suppressing the dispersion of positive ions by the airflow of air-fuel mixture can be considered.

The spark plug 10 shown in FIG. 3 is attached to the cylinder head of the engine such that the ground electrode 110 functions as a member for weakening the intensity of the airflow of air-fuel mixture flowing into the gap G. More specifically, the spark plug 110 is attached to the cylinder head such that the leg portion 111 of the ground electrode 110 is placed further upstream than the gap G in the flow direction F of the air flow during the compression step. As a result, the dispersion of positive ions by the airflow of air-fuel mixture is suppressed. The range of variation in the discharge waiting time can be reduced.

Figure 5:
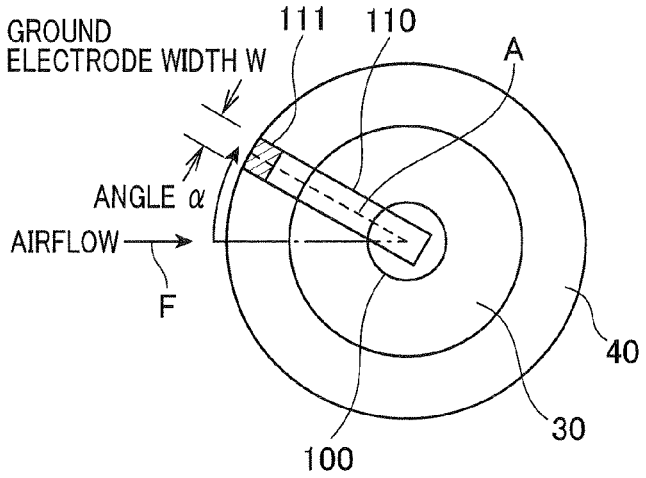
FIG. 5 is a diagram of the spark plug viewed from a plug tip side.

FIG. 5 shows a state of the center electrode 100 and the ground electrode 110 viewed from the axial direction of the center electrode 100. Line A connects the center of the leg portion 111 of the ground electrode 110 and the center of the center electrode 100. The position of the ground electrode 110 is expressed by an angle $\alpha$ formed by airflow F and the line A. When the angle $\alpha$ is zero degrees, the leg portion 111 is positioned directly upstream of the gap G in the flow direction F of airflow during the compression step. The intensity of airflow attempting to flow into the gap G can be most effectively weakened.

Figure 6:
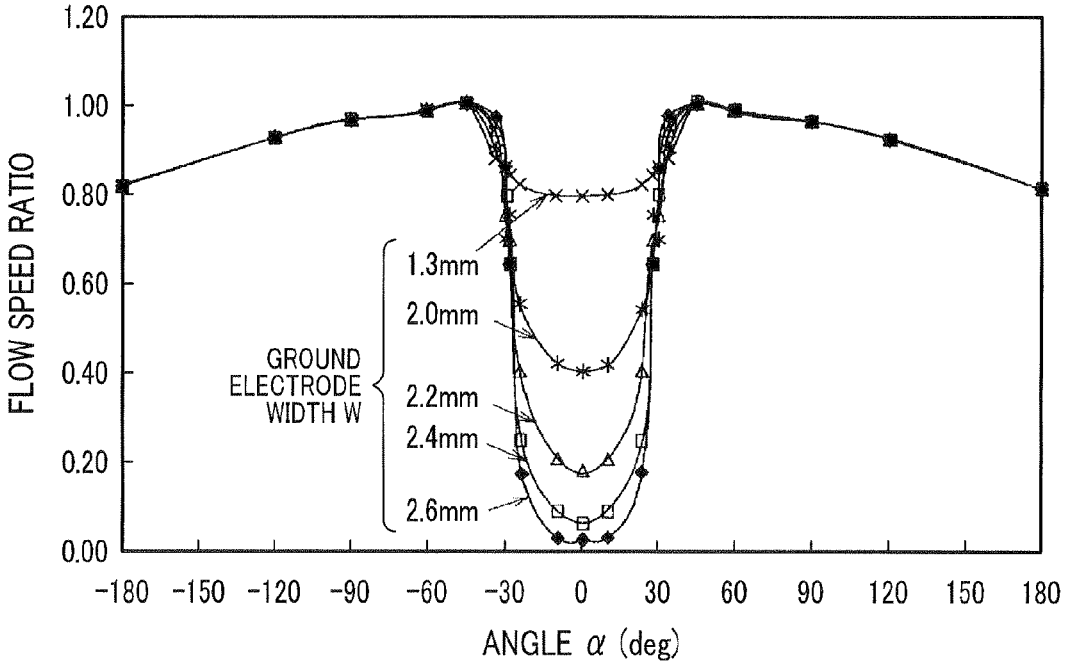
FIG. 6 is a graph showing a relationship between a position of a ground electrode and a flow speed ratio.

FIG. 6 shows a correlation between the angle $\alpha$ expressing the position of the ground electrode 110, the width W of the ground electrode 110, and a flow speed ratio of the airflow in the gap G. Here, the flow speed ratio of the airflow in the gap G refers to the ratio of the flow speed of the air-fuel mixture generated in the gap G at each attachment angle $\alpha$ in relation to a maximum flow speed of the air-fuel mixture generated between the gap.

When the angle $\alpha$ is 45 degrees, the flow speed of the air-fuel mixture generated in the gap G is the maximum flow speed. The smaller the flow speed ratio is, the more weakened the intensity of the airflow flowing into the gap G becomes by the ground electrode 110. The correlation between the angle $\alpha$, the width W of the ground electrode 110, and the flow speed ratio is obtained by simulation performed with the engine speed fixed at a constant speed (3500 rpm).

In FIG. 6, the flow speed ratio significantly decreases in the range in which the angle $\alpha$ is −30 degrees to 30 degrees. In the range in which the angle $\alpha$ is −30 degrees to 30 degrees, the flow speed ratio decreases as the absolute value of angle $\alpha$ becomes smaller. In addition, in the range in which the angle $\alpha$ is −30 degrees to 30 degrees, as the width W of the ground electrode 110 increases, the flow speed ratio becomes smaller because the intensity of the airflow is weakened by the ground electrode 110. In other words, it is clear that the intensity of the airflow is also weakened by the width W of the ground electrode 110 being widened, in addition to the angle $\alpha$ (absolute value) being made smaller.

Here, to suppress the dispersion of positive ions by the airflow of air-fuel mixture and reduce the range of variation in the discharge waiting period, it is considered preferable than the flow speed ratio is 0.6 or less. Therefore, the width W and position (angle α) of the ground electrode 110 are preferably determined such that the flow speed ratio is 0.6 or less.

From the relationship shown in FIG. 6, when the width W of the ground electrode 110 is 1.3 mm, the minimum value of the flow speed ratio is greater than 0.6 (flow speed ratio=about 0.8). Therefore, when the width W of the ground electrode 110 is 1.3 mm, the effect of suppressing the dispersion of positive ions is insufficient.

On the other hand, when the width W of the ground electrode 110 is 2.0 mm, 2.2 mm, 2.4 mm, or 2.6 mm, the flow speed ratio becomes 0.6 or less when the angle α ranges from −30 degrees to 30 degrees. In other words, when the angle α ranges from −30 degrees to 30 degrees and the width W of the ground electrode 110 is 2.0 mm or more, the effect of suppressing the dispersion of positive ions can be sufficiently achieved.

In addition, to more favorably suppress the dispersion of positive ions present in the gap G, it is considered preferable that the flow speed ratio is 0.5 or less. In this regard, from the relationship shown in FIG. 6, for example, the angle α may be any angle ranging from −20 degrees to 20 degrees with the width W of the ground electrode 110 at 2.0 mm or more.

Furthermore, setting the flow speed ratio to 0.2 or less can be considered. In this regard, from the relationship shown in FIG. 6, for example, the angle α may be any angle ranging from −25 degrees to 25 degrees with the width W of the ground electrode 110 at 2.4 mm or more.

When the angle α (absolute value) is reduced and the flow speed ratio is set to a predetermined value or less (such as 0.6 or less), the effect of suppressing the dispersion of positive ions can be achieved. However, the flow speed of the air-fuel mixture flowing into the gap G becomes slow. As a result, reduced spread of combustion flame after ignition by the discharge spark becomes a concern. Therefore, to suppress excessive slowing of the flow speed of the air-fuel mixture flowing into the gap G, a lower limit value of the flow speed ratio is preferably set.

Specifically, the lower limit value of the flow speed ratio is set to 0.1. In this instance, the width W of the ground electrode 110 and the angle α may be adapted such that the flow speed ratio is 0.1 or more and 0.6 or less. In terms of the angle α of the ground electrode 110, in addition to an upper limit value (−30 degrees and 30 degrees) of the tilt in relation of the flow direction F of the airflow, a lower limit value (−10 degrees and 10 degrees) may be set. As a result, the occurrence of a flameout can be suppressed while reducing the range of variation in the discharge waiting period.

According to the first embodiment, the width W of the leg portion 111 of the ground electrode 110 is 2.4 mm. The spark plug 10 is attached to the cylinder head such that the angle α is 20 degrees.

According to the first embodiment, the orientation of the electrodes in the spark plug 10 corresponds with the direction of airflow in the combustion chamber, as described above. However, the state within the combustion chamber cannot be visibly checked from outside of the engine. Therefore, a configuration is preferable that allows the orientation of the electrodes in the spark plug 10 to be known from outside of the engine as well. Thus, a positioning means for performing positioning in a plug rotation direction is provided in the spark plug 10.

Specifically, as shown in FIG. 3, a position display section 50 is provided that indicates the position of the leg portion 111 of the ground electrode 110. The position display section 50 is provided in a position on the spark plug 10 that is visible from outside of the engine even after the spark plug 10 is attached to the cylinder head.

For example, the position display section 50 may be provided in the upper portion of the insulator 30 and be visible from above in FIG. 3. The position display section 50 is, for example, a marking of a specific notation, such as an arrow or a character. Here, the position display section 50 is merely required to be provided in a position on the spark plug 10 that is visible from outside of the engine even after the spark plug 10 is attached to the cylinder head. For example, the position display section 50 may be provided on a top surface of a terminal of a spark plug 10.

When the spark plug 10 is attached to the cylinder head, the male screw portion **40*a* is screwed into the cylinder head. In a state in which the spark plug 10 is attached by a predetermined fastening torque, the positioning of the ground electrode 110 is performed by an operation performed while watching the position display section 50**.

Other means can also be used as the positioning means. For example, a turn stopping portion may be provided in the male screw portion **40*a* of the spark plug 10. The rotation (screwing) of the spark plug 10 may be restricted by the turn stopping portion, thereby positioning the ground electrode 110. The turn stopping portion may be configured by, for example, a projecting portion being provided in the male screw portion 40*a* and the function of stopping the turning of the spark plug 10 being achieved in a state in which the spark plug 10** is attached by a predetermined fastening torque.

Figure 7:
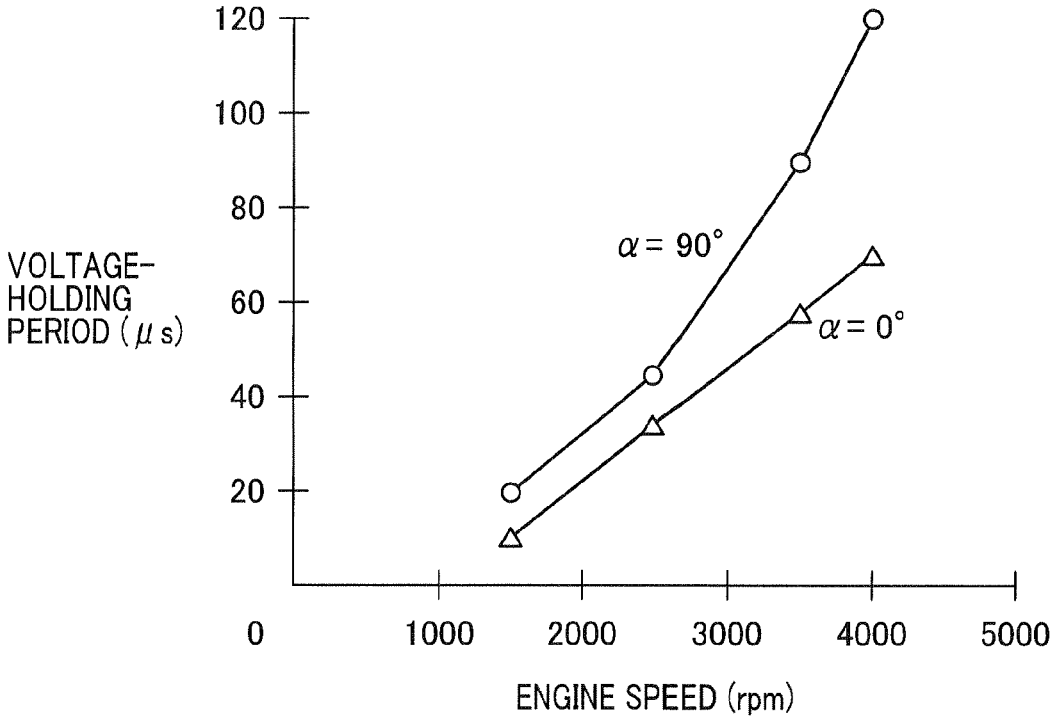
FIG. 7 is a graph showing a relationship between an engine speed and a voltage-holding period.

FIG. 7 shows a relationship between engine speed and voltage-holding period when the angle α is 0 degrees and 90 degrees. The voltage-holding period refers to the duration of the state in which the secondary voltage V2 is held at the breakdown voltage Vz after application of voltage to the center electrode 100 (time t1 to t2 in FIG. 2).

In FIG. 7, the faster the engine speed, the faster the flow speed of the air-fuel mixture during the compression step, and the faster the airflow into the gap G. In addition, the positive ions generated in the gap G are more easily carried away. Therefore, the faster the engine speed, the longer the voltage-holding period (also applies to the discharge waiting period). In addition, when the angle α is zero degrees, the dispersion of positive ions is more suppressed compared to when the angle α is 90 degrees. Therefore, the voltage-holding period becomes shorter.

Furthermore, the faster the engine speed is, the greater the difference in the voltage-holding period between when the angle α is zero degrees and when the angle α is 90 degrees. In other words, the faster the engine speed and the flow speed of the air-fuel mixture are, the greater the effect of suppressing the dispersion of positive ions achieved by the leg portion 111 of the ground electrode 110 being positioned upstream of the gap G.

The effects achieved according to the first embodiment are as follows.

The spark plug 10 is attached to the cylinder head such that the leg portion 111 of the ground electrode 110 is further upstream than the gap G in relation to the airflow of the air-fuel mixture generated within the combustion chamber during the compression step. As a result, the intensity of the airflow of the air-fuel mixture is weakened by the leg portion 111 of the ground electrode 110. The dispersion of positive ions in the gap G caused by the airflow can be prevented.

Therefore, in the ignition device in which the discharge waiting period occurs as a result of the voltage applied to the center voltage 100 being restricted to a predetermined voltage, the delay in the electron avalanche phenomenon accompanying the dispersion of positive ions can be suppressed. Variations in the discharge waiting period can be suppressed. As a result, stabilization of the combustion state of the engine can be achieved.

The spark plug 10 is configured such that a negative voltage is applied to the center electrode 100. In this instance, as a result of the density of positive ions increasing in the space near the center electrode 100 and the electric field intensifying, as well as the center electrode 100 having a smaller opposing area in the gap G compared to the ground electrode 110, shortening of the discharge waiting period can be achieved. When the discharge waiting period is shortened by the electric field becoming intensified in this way, the effect of suppressing the variations in the discharge waiting period can be enhanced.

As an attachment state of the spark plug 10, the angle α expressing the position of the ground electrode 110 ranges from −30 degrees to 30 degrees. In addition, the width W of the ground electrode 110 is 2.0 mm or more. As a result, the flow speed ratio of airflow in the gap G can be set to a desired value (0.6 or less). The dispersion of positive ions can be favorably suppressed.

As the angle α expressing the position of the ground electrode 110, a lower limit value (−10 degrees and 10 degrees) is set in addition to the upper limit value (−30 degrees and 30 degrees) of the tilt in relation to the flow direction F of the airflow. As a result, reduction of spreading of combustion flame after ignition of the air-fuel mixture by the discharge spark can be suppressed, while restricting the flow of air-fuel mixture flowing into the gap G. In other words, suppression of the variations in the discharge waiting period and suppression of reduced combustibility can both be achieved.

The position display section 50 is provided as the positioning means in the spark plug 10. Therefore, the position (angle α) of the ground electrode 110 within the combustion chamber can be easily adjusted to a desired position. As a result, a favorable configuration can be actualized in terms of suppressing the variations in the discharge waiting period, as described above.

Second Embodiment

According to a second embodiment, a Zener diode is provided within the spark plug 10.

Figure 8:
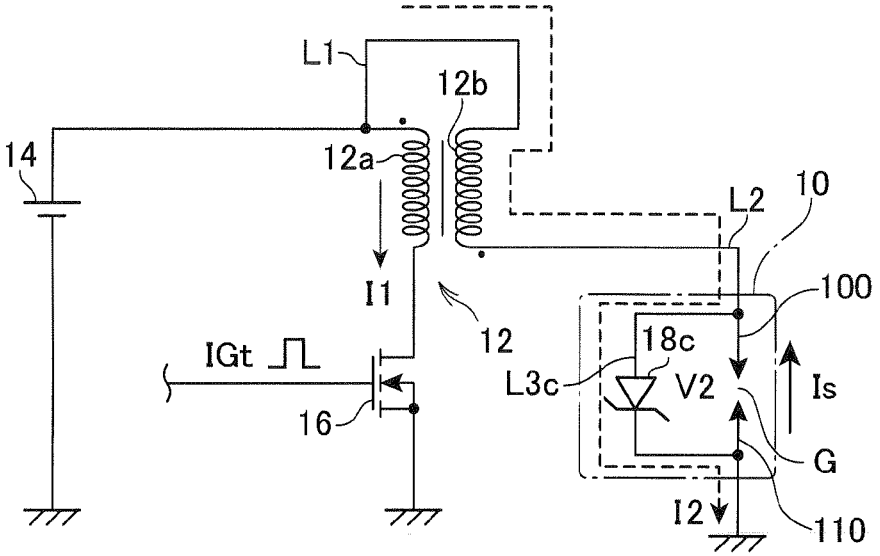
FIG. 8 is a diagram showing a configuration of an ignition device according to a second embodiment.

FIG. 8 shows an overall configuration of an ignition device according to the second embodiment. In FIG. 8, components that are the same as those in FIG. 1, described above, are given the same reference numbers for convenience. In addition, the ECU 20 is omitted in FIG. 8.

As shown in FIG. 8, according to the second embodiment, a constant voltage path L3*c* and the Zener diode 18*c* are provided inside of the spark plug 10. The constant voltage path L3*c* connects the center electrode 100 and the ground electrode 110. The Zener diode 18*c* is provided on the constant voltage path L3*c*. The Zener diode 18*c* is provided such that the anode faces the center electrode 100 side and the cathode faces the ground electrode 110 side.

As a result of a configuration such as this, the paths connecting the Zener diode 18*c* to the center electrode 100 and the ground electrode 110 of the spark plug 10 can be shortened. Therefore, the electrical path on which a high voltage is applied, including the constant voltage path L3*c*, can be shortened. The voltage between the center electrode 100 and the ground electrode 110 can be more accurately restricted to the breakdown voltage Vz of the Zener diode 18*c*. Because the accuracy of the restriction value of the voltage between the center electrode 100 and the ground electrode 110 improves, the variations in the discharge waiting period can be suppressed. Stabilization of the combustion state of the engine can be achieved.

In addition, the reliability of electrical insulation between the electrical paths on which the high voltage is applied and the grounding area (body earth) can be improved. In addition, the paths connecting the center electrode 100 and the ground electrode 110 to the Zener diode 18*c* can be shortened.

Therefore, distributed capacitance can be reduced. Noise (electromagnetic waves) occurring when the high voltage is applied to the gap G can be suppressed. Malfunction of the ignition device and electrical components disposed near the ignition device can be prevented, and the like. Furthermore, wire inductance on the constant voltage path L3*c* and the like can be reduced, and reduction of electromagnetic energy stored in the ignition coil 12 can also be suppressed.

Third Embodiment

Figure 9:
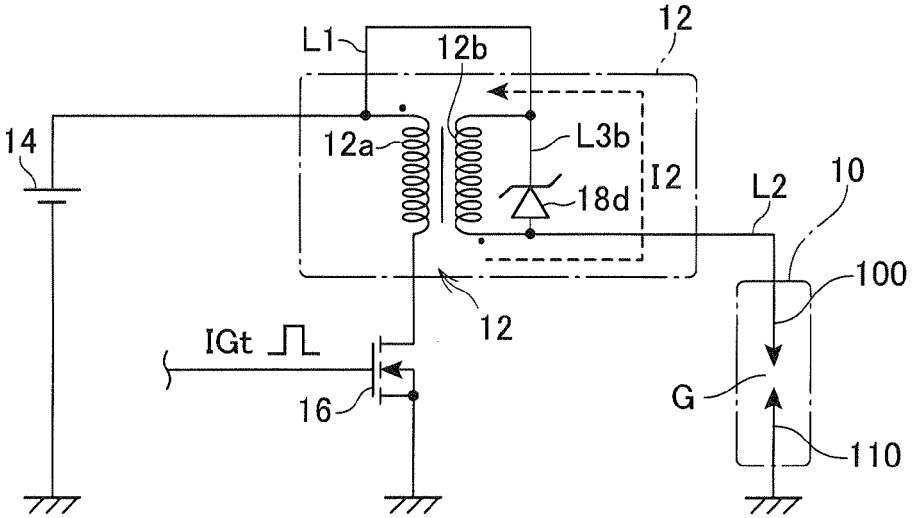
FIG. 9 is a diagram showing a configuration of an ignition device according to a third embodiment.

FIG. 9 shows an overall configuration of an ignition device according to a third embodiment. In FIG. 9, components that are the same as those in FIG. 1, described above, are given the same reference numbers for convenience. In addition, the ECU 20 is omitted in FIG. 9.

As shown in FIG. 9, according to the third embodiment, the secondary coil 12*b* side of both ends of the low-voltage side path L1 and the connection path L2 are connected by a constant voltage path L3*b*. A Zener diode 18*d* is provided on the constant voltage path L3*b*. The Zener diode 18*d* is provided such that the cathode faces the low-voltage side path L1 and the anode faces the connection path L2.

As a result of a configuration such as this, in an instance in which the ignition signal IGt is switched from an ON ignition signal to an OFF ignition signal, when the induced voltage of the secondary coil 12*b* attempts to exceed the breakdown voltage Vz of the Zener diode 18*d*, the induced voltage is restricted to the breakdown voltage Vz. In other words, the voltage applied to the gap G is held at the breakdown voltage Vz.

Furthermore, according to the third embodiment, the Zener diode 18*d* is provided within the ignition coil 12. As a result of a configuration such as this, the path connecting the secondary coil 12*b* and the center electrode 100 of the spark plug 10 can be shortened.

Therefore, effects similar to those according to the above-described second embodiment, such as accurate restriction of the voltage between the center electrode 100 and the ground electrode 110 to the breakdown voltage Vz of the Zener diode 18*d*, can be achieved.

Other Embodiments

The above-described embodiments may be modified as follows.

According to the above-described embodiments, as the angle α indicating the position of the ground electrode 110, the lower limit value (−10 degrees and 10 degrees) is set in addition to the upper limit value (−30 degrees and 30 degrees) of the tilt in relation to the airflow. However, the lower limit value may not be set, and the angle α may be zero degrees.

The voltage regulator serving as the voltage restricting means is not limited to that given as an example in the above-described embodiments. For example, the voltage regulator may be an avalanche diode in which an avalanche breakdown occurs when the voltage between its own terminals becomes a specified voltage. In addition, for example, the voltage regulator may be an element other than the Zener diode or the avalanche diode that has similar functions as the Zener diode or the avalanche diode.

The voltage restricting means may be that which restricts the output voltage of the secondary coil 12*b* by controlling the current flowing to the primary coil 12*a*. For example, during the period in which the ignition signal IGt is an OFF ignition signal according to the above-described embodiments, the configuration is such that a predetermined voltage lower than a voltage level (such as 5V) of the ON ignition signal is applied to the opening/closing control terminal of the switching element 16.

As a result, the switching element 16 enters a semiconducting state. A predetermined current flows to the primary coil 12*a*, and the secondary voltage V2 that is the output voltage of the secondary coil 12*b* can be restricted to a predetermined voltage or less.

The spark plug 10 may be attached by being pressed into a plug attaching section of the cylinder head. In the press-in attachment structure, the orientation of the ground electrode 110 in relation to the gap G can be easily adjusted.

What is claimed is:

1. An ignition device, comprising:

a spark plug that is attached to a cylinder head of an internal combustion engine such that a center electrode and a ground electrode project into a combustion chamber of the internal combustion engine; and an ignition coil having a primary coil and a secondary coil that are magnetically coupled with each other, the center electrode and the ground electrode opposing each other in an axial direction of the spark plug, a gap being formed between the center electrode and the ground electrode such that a discharge spark is generated in the gap, energization of the primary coil being started and subsequently interrupted to apply a high voltage to the center electrode such that the discharge spark is generated in the gap, wherein:

the internal combustion engine is configured to generate airflow in a predetermined direction to the spark plug during a compression step;

a voltage restricting means is included that restricts an output voltage of the secondary coil after the energization of the primary coil is interrupted to a predetermined voltage or less;

the ground electrode has a leg portion that extends from a housing of the spark plug and an opposing portion that extends in a direction intersecting with the leg portion and forms the gap by opposing the center electrode, the ground electrode having a width of between 2.0 mm and 2.6 mm;

the leg portion is attached to a position further upstream than the gap in a flow direction of the airflow during the compression step; and the spark plug is attached to the cylinder head such that an angle is between 10 degrees and 30 degrees, where the angle is an angle between a flow direction of the airflow of air-fuel mixture during the compression step and a line that connects a center of the leg portion and a center of the center electrode which are viewed from a tip side in an axial direction of the spark plug.

2. The ignition device according to claim 1, wherein the spark plug is connected to the ignition coil such that a negative voltage is applied to the center electrode when the discharge spark is generated in the gap.

3. The ignition device according to claim 1, wherein the spark plug is attached to the cylinder head such that a flow speed ratio is 0.6 or less, where the flow speed ratio is a ratio of a flow speed of airflow of air-fuel mixture in the gap in relation to a maximum flow speed which is a maximum flow speed of air-fuel mixture in the gap determined based on an attachment position of the leg portion when the airflow is generated in the combustion chamber during the compression step.

4. The ignition device according to claim 3, wherein the spark plug includes:

a male screw portion that is provided in an outer periphery of the housing, the spark plug being attached to the cylinder head by the male screw portion being screwed into the cylinder head; and positioning means for positioning in a plug rotation direction such that the leg portion is positioned upstream of the gap in a flow direction of the airflow when the spark plug is attached.

5. The ignition device according to claim 4, wherein the voltage restricting means is provided within the spark plug or the ignition coil.

6. The ignition device according to claim 1, wherein the spark plug is attached to the cylinder head such that a flow speed ratio is 0.6 or less, where the flow speed ratio is a ratio of a flow speed of airflow of air-fuel mixture in the gap in relation to a maximum flow speed which is a maximum flow speed of air-fuel mixture in the gap determined based on an attachment position of the leg portion when the airflow is generated in the combustion chamber during the compression step.

7. The ignition device according to claim 6, wherein the spark plug includes:

a male screw portion that is provided in an outer periphery of the housing, the spark plug being attached to the cylinder head by the male screw portion being screwed into the cylinder head; and positioning means for positioning in a plug rotation direction such that the leg portion is positioned upstream of the gap in a flow direction of the airflow when the spark plug is attached.

8. The ignition device according to claim 7, wherein the voltage restricting means is embedded in the spark plug or the ignition coil.

9. The ignition device according to claim 1, wherein the spark plug is attached to the cylinder head such that a flow speed ratio is 0.6 or less, where the flow speed ratio is a ratio of a flow speed of airflow of air-fuel mixture in the gap in relation to a maximum flow speed which is a maximum flow speed of air-fuel mixture in the gap determined based on an attachment position of the leg portion when the airflow is generated in the combustion chamber during the compression step.

10. The ignition device according to claim 1, wherein the spark plug includes:

a male screw portion that is provided in an outer periphery of the housing, the spark plug being attached to the cylinder head by the male screw portion being screwed into the cylinder head; and positioning means for positioning in a plug rotation direction such that the leg portion is positioned upstream of the gap in a flow direction of the airflow when the spark plug is attached.

11. The ignition device according to claim 1, wherein the voltage restricting means is embedded in the spark plug or the ignition coil.

12. The ignition device according to claim 1, wherein the spark plug is attached to the cylinder head such that the angle is 20 degrees or less.

* * * * *